US006079385A

United States Patent [19]

Wicke

[11] Patent Number: 6,079,385

[45] Date of Patent: Jun. 27, 2000

[54] ARRANGEMENT FOR DRIVING ENGINE ACCESSORIES

[75] Inventor: Wolfgang Wicke, Hannover, Germany

[73] Assignee: Daimler Chrysler AG, Stuttgart, Germany

[21] Appl. No.: 09/096,992

[22] Filed: Jun. 13, 1998

[30] Foreign Application Priority Data

Jun. 15, 1997 [DE] Germany ..... 197 25 216

[51] Int. Cl.[7] ..... F02B 67/06

[52] U.S. Cl. ..... 123/198 R; 123/41.49; 474/74

[58] Field of Search ..... 123/198 R, 41.49; 474/74

[56] References Cited

U.S. PATENT DOCUMENTS

| | | | |
|---|---|---|---|
| 2,911,961 | 11/1959 | McRae | 123/41.11 |
| 2,964,959 | 12/1960 | Beck et al. | 74/368 |
| 3,730,147 | 5/1973 | Buchwald | 123/198 R |
| 3,884,089 | 5/1975 | Avramidis | 474/74 |
| 4,215,658 | 8/1980 | Smith, Jr. et al. | 123/198 R |
| 4,613,318 | 9/1986 | McWilliam et al. | 474/74 |
| 5,372,106 | 12/1994 | Botterill | 123/198 R |
| 5,529,028 | 6/1996 | Weikert | 123/198 R |
| 5,704,331 | 1/1998 | Eberbach et al. | 123/198 R |

FOREIGN PATENT DOCUMENTS

| | | |
|---|---|---|
| 2 378 948 | 8/1978 | France . |
| 24 23 746 | 11/1975 | Germany . |
| 195 11 702 | 10/1996 | Germany . |
| 58-118424 | 7/1983 | Japan . |

*Primary Examiner*—Noah P. Kamen
*Assistant Examiner*—Jason Benton
*Attorney, Agent, or Firm*—Klaus J. Bach

[57] ABSTRACT

In an arrangement for driving accessories of an internal combustion engine such as a water pump and a fan by means of a V-belt drive operated by an engine crankshaft wherein a first belt pulley is mounted on the crankshaft for rotation therewith, a second pulley is mounted on a water pump shaft to be driven by the first pulley via a first V-belt, a third pulley is mounted on the water pump shaft for rotation therewith and a fourth pulley is rotatably mounted on the crankshaft or an extension thereof and driven by the third pulley via a second V-belt and a fan is mounted for rotation with the fourth pulley via clutch so that the fan can be operated at a speed different from the crankshaft speed.

4 Claims, 3 Drawing Sheets

ARRANGEMENT FOR DRIVING ENGINE ACCESSORIES

BACKGROUND OF THE INVENTION

The invention relates to an arrangement for driving accessories of an internal combustion engine such as a water pump or a fan by means of a V-belt drive operated by the engine crankshaft.

It is generally known to connect the fan directly to the crankshaft or to an extension of the crankshaft in order to drive the fan directly. Additional engine accessories or aggregates such as the water pump, a generator, an AC compressor or other auxiliary aggregates are generally driven by a V-belt drive using one belt for all aggregates.

DE 195 11 702 A1 and DE 24 23 746 C2 show that it is also known to drive the fan by way of the water pump shaft wherein generally the water pump is connected to the crankshaft by means of a V-belt drive. The fan is arranged co-axially with the pump shaft and is driven thereby by way of clutch.

It is, however a disadvantage that the forces that is the load generated by the fan acts on the whole drive consisting of the belt drive and the aggregates driven thereby. In addition, the speed of the fan is determined by the engine speed or, respectively, the water pump speed.

It is therefore the object of the present invention to provide an arrangement of the type referred to above, wherein however, the fan transmission ratio is independent of the basic belt drive and wherein the forces and loads generated by the fan are not taken up by the whole basic belt drive.

SUMMARY OF THE INVENTION

In an arrangement for driving accessories of an internal combustion engine such as a water pump and a fan by means of a V-belt drive operated by an engine crankshaft wherein a first belt pulley is mounted on the crankshaft for rotation therewith, a second pulley is mounted on a water pump shaft to be driven by the first pulley via a first V-belt, a third pulley is mounted on the water pump shaft for rotation therewith and a fourth pulley is rotatably mounted on the crankshaft or an extension thereof and driven by the third pulley via a second V-belt, and a fan is mounted for rotation with the fourth pulley via a clutch so that the fan can be operated at a speed different from the crankshaft speed.

With this arrangement, the fan drive is separated from the basic drive arrangement. As a result, there are no reaction forces from the fan drive effective on the basic drive and the fan can be driven with any transmission ratio considered to be desirable for driving the fan although it too is driven by the cam shaft. This has become possible with the arrangement wherein the water pump or rather the water pump shaft acts only as an intermediate drive and wherein the fan, although being supported by the crankshaft, is still rotatable relative thereto. The relative rotatability can be achieved, for example by an anti-friction bearing arrangement such as a ball bearing by which the fan drive pulley is supported. Basically, the drive shaft for the fan itself is arranged coaxially with the crankshaft, but is rotationally uncoupled therefrom.

Another advantage of the arrangement according to the invention resides in the fact that costs and weights are reduced. Motion transmission to the fan from the crankshaft can be to a lower as well as to a higher speed.

Belt forces generated by the fan are taken up by the water pump pulley. As a result, the other aggregates associated with the main belt drive do not need any bearing strengthening.

A preferred-embodiment of the invention will be described below on the basis of the accompanying drawing.

DESCRIPTION OF A PREFERRED EMBODIMENT

Figure 1:
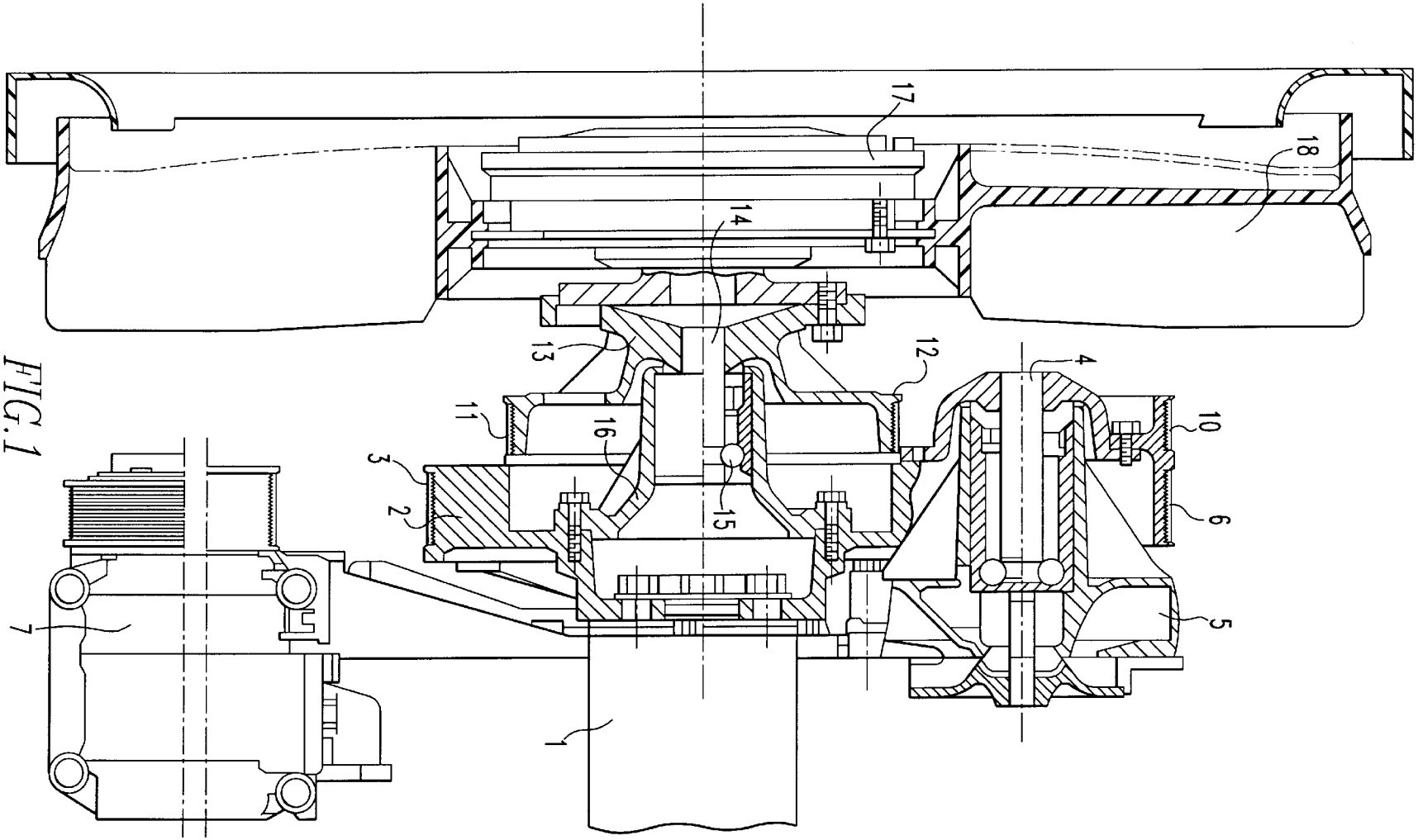
FIG. 1 is a side view of the drive arrangement according to the invention.
Figure 2:
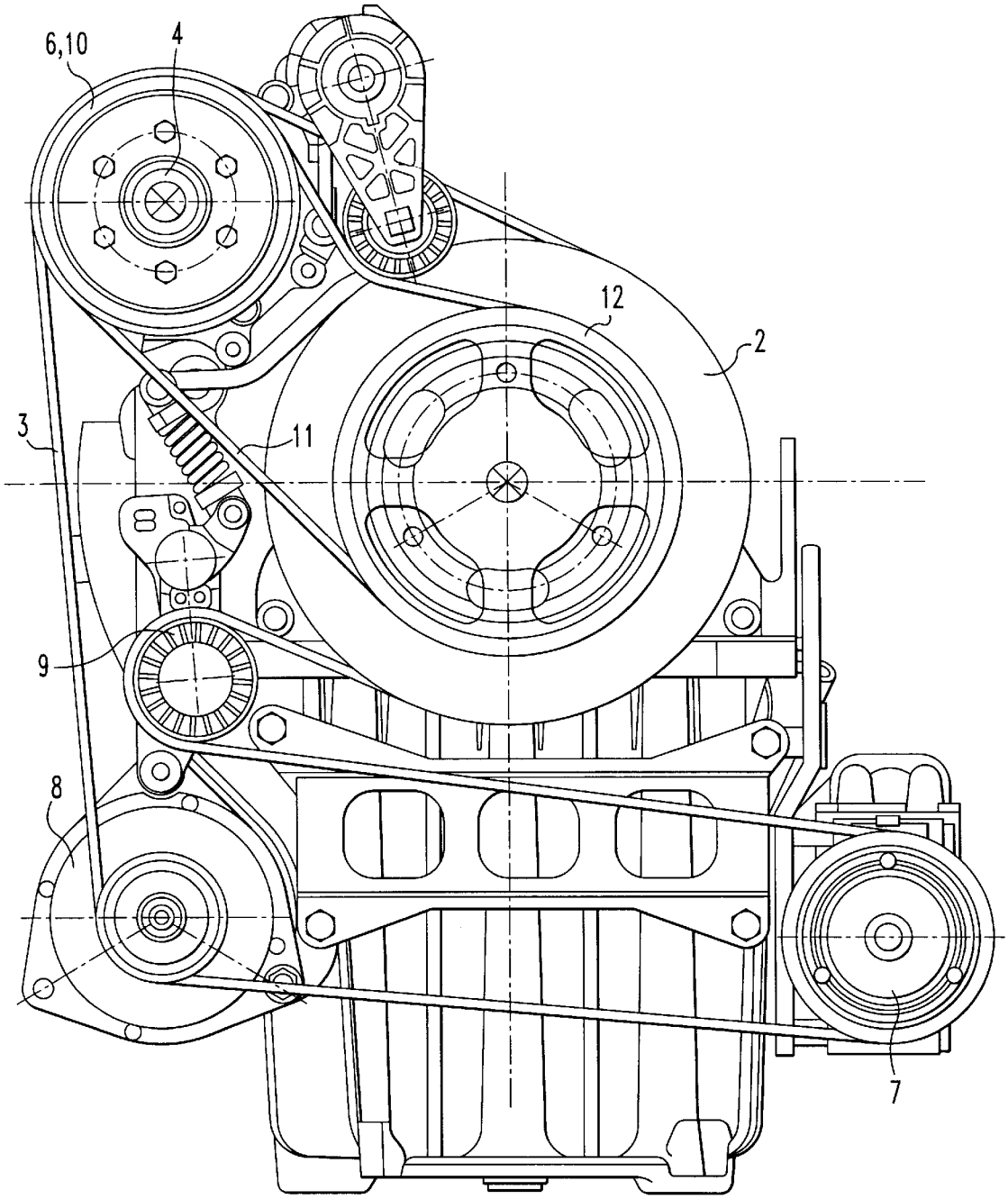
FIG. 2 is a front view of the drive arrangement.
Figure 3:
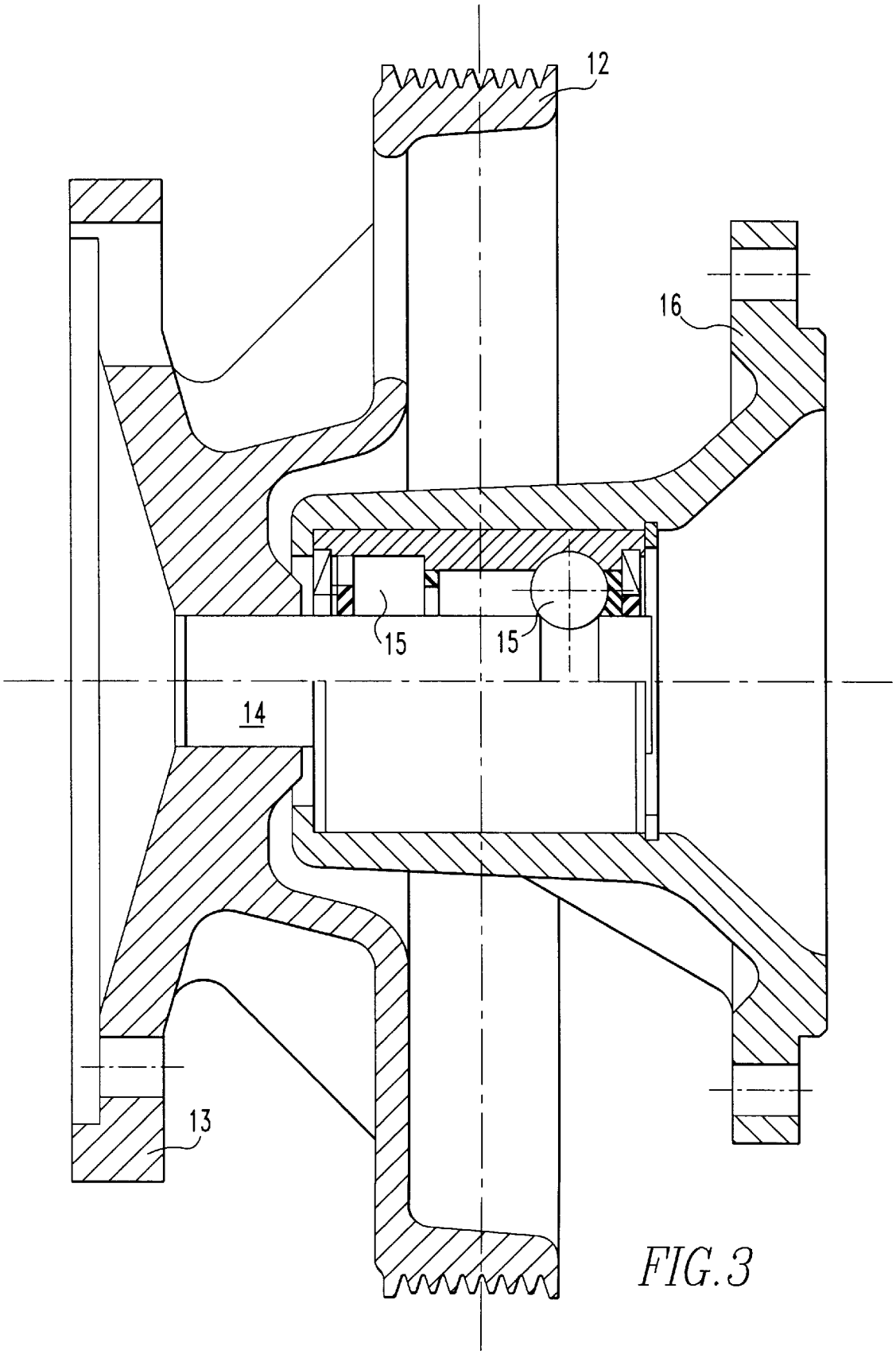
FIG. 3 is an enlarged cross-sectional view of the bearing structure for the fourth V-belt pulley.

As shown in FIG. 1, a first pulley 2 is disposed on a crankshaft 1 of which only the front end is shown and, because the pulley is mounted on the crankshaft, rotates at engine speed. A first V-belt 3 is disposed on the first pulley 2 and a second pulley 6 which is disposed on the shaft 4 of a water pump 5 so as to be driven by the crankshaft. The V-belt 3 extending around the second pulley 6 and drives additional auxiliary aggregates such as on AC compressor 7 and an alternator 8 each of which is provided with a drive pulley. A belt tensioning roller 9 is arranged between the first pulley 2 and the AC compressor 7 so as to provide the desired tension for the V-belt 3.

From the alternator 8, the V-belt returns to the pulley 6 of the water pump 5. The pulleys 2 and 6, the water pump 5, the AC compressor 7 (if present) and the alternator 8 form, together with the V-belt 3 interconnecting these aggregates, a basic belt drive unit. The water pump shaft 4 has a double belt pulley or a third pulley 10. The third pulley 10 is drivingly connected to a fourth pulley 12 by way of a second belt 11 thereby forming a second belt drive unit. The fourth pulley 12 is provided with a connecting flange 13, which is disposed on an intermediate shaft 14. The intermediate shaft 14 is supported in the interior of a carrier 16 by way of a roller bearing and a ball bearing structure 15. The carrier 16 is connected to the first V-belt pulley 2 by mounting bolts.

With this support arrangement, the fourth pulley 12 is disposed co-axially with the crankshaft 1, but is not rotatably coupled thereto so that it can rotate at a speed different from that of the crankshaft 1. The speed of the fourth belt pulley 12 and the connecting flange 13 attached thereto depends on the transmission ratio of the V-belt pulleys 2, 6, 10 and 12, that is, their relative diameters. In this way, any desired transmission ratio can be provided for the fourth pulley 12. The flange 13 is connected to a clutch, for example, a viscous clutch 17, which is co-axial with the intermediate shaft 14 and, consequently, also coaxial with the crankshaft 1. A fan 18 is mounted onto the clutch 17. The design and way of operation of the clutch and its connection with the fan 18 are well known in the art and are therefore not described in detail.

The drive for the fan 18 by the way of the pulley 10 disposed on the water pump shaft 4 and the fourth belt pulley 12 supported on the intermediate shaft 14 which is co-axially with the crankshaft 1 but rotationally independent of the crank shaft. This is true with regard to bearing reaction forces as well as the possibility to provide any desired transmission ratio for the fan drive.

What is claimed is:

1. An arrangement for driving a fan of an internal combustion engine by means of a V-belt drive operated by an engine crankshaft, said arrangement comprising: a first belt pulley mounted on said crankshaft for rotation therewith, a second pulley mounted on a water pump drive shaft so as to be driven by said crankshaft via a first V-belt extending around said first and second pulleys and forming a first belt drive, a third belt pulley mounted on said water pump drive shaft for rotation therewith, a fourth pulley supported by said crankshaft so as to be rotatable relative thereto, and a second belt extending around said third and fourth pulleys for drivingly connecting said third pulley to said fourth pulley and forming a second belt drive, and a fan mounted for rotation with said fourth pulley.

2. An arrangement according to claim 1, wherein said first belt drive includes additional auxiliary engine aggregates which are all driven by way of said first V-belt.

3. An arrangement according to claim 1, wherein said fourth pulley is connected, by way of a flange, to a clutch and said fan is connected to said clutch to be driven thereby when said clutch is engaged.

4. An arrangement according to claim 1, wherein said fourth pulley is rotatably supported on an extension of said crank shaft by an anti-friction bearing structure.

* * * * *